US007017354B2

(12) United States Patent
Lee et al.

(10) Patent No.: US 7,017,354 B2
(45) Date of Patent: Mar. 28, 2006

(54) QUICK ICE-MAKING CONTROL METHOD OF ICE-MAKER FOR REFRIGERATOR

(75) Inventors: Myung Ryul Lee, Kyunggi-do (KR); Seong Jae Kim, Kyunggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/847,368

(22) Filed: May 18, 2004

(65) Prior Publication Data

US 2005/0072166 A1 Apr. 7, 2005

(30) Foreign Application Priority Data

Oct. 7, 2003 (KR) ..... 10-2003-0069607

(51) Int. Cl.
*F25C 5/08* (2006.01)

(52) U.S. Cl. ..... 62/73; 62/353

(58) Field of Classification Search ..... 62/68, 62/73, 353

See application file for complete search history.

(56) References Cited

U.S. PATENT DOCUMENTS

| | | | | |
|---|---|---|---|---|
| 2,942,430 A | | 6/1960 | Rising et al. | |
| 3,933,531 A | * | 1/1976 | Sawa et al. | 428/470 |
| 3,959,981 A | | 6/1976 | Anderson | |
| 4,184,339 A | * | 1/1980 | Wessa | 62/68 |
| 4,217,762 A | | 8/1980 | Sakamoto | |
| 4,872,318 A | | 10/1989 | Klemmenesen | |
| 4,923,494 A | * | 5/1990 | Karlovits | 62/73 |
| 5,010,738 A | | 4/1991 | Brown et al. | |
| RE33,612 E | * | 6/1991 | Cole | 62/233 |
| 5,172,556 A | * | 12/1992 | Oike | 62/68 |
| RE34,174 E | | 2/1993 | Brown et al. | |
| 5,845,513 A | * | 12/1998 | Fornasari | 62/353 |
| 6,351,955 B1 | * | 3/2002 | Oltman et al. | 62/71 |

FOREIGN PATENT DOCUMENTS

| | | |
|---|---|---|
| FR | 2575275 | 7/1986 |
| GB | 2332738 | 6/1999 |
| JP | 11-63758 | 3/1999 |

OTHER PUBLICATIONS

English Language Abstract of JP 11-63758.

* cited by examiner

*Primary Examiner*—William E. Tapolcai
(74) *Attorney, Agent, or Firm*—Greenblum & Bernstein, P.L.C.

(57) ABSTRACT

Disclosed is a quick ice-making control method of an ice-maker for a refrigerator, in which an ejector for extracting obtained ice stirs supplied water to be frozen so as to promote thermal transmission of the water. The quick ice-making control method includes the steps of (a) supplying water into an ice-maker mold, (b) quickly freezing the water by rotating an ejector for a predetermined time after the step (a), and (c) separating the obtained ice from the ice-maker mold in case that a temperature of the ice-maker mold is lower than a predetermined temperature after the step (b).

20 Claims, 14 Drawing Sheets

QUICK ICE-MAKING CONTROL METHOD OF ICE-MAKER FOR REFRIGERATOR

BACKGROUND OF THE INVENTION

1. Field of the Invention

The present invention relates to a quick ice-making control method of an ice-maker for a refrigerator, and more particularly to a quick ice-making control method of an ice-maker for a refrigerator, in which water supplied to be made into ice cubes is stirred with an ejector for exhausting the ice cubes.

2. Description of the Related Art

Generally, refrigerators maintain a freezing chamber or a refrigerating chamber at a low temperature by means of a refrigerating cycle of a refrigerant.

FIG. 1 is a perspective view of a conventional refrigerator.

As shown in FIG. 1, the conventional refrigerator comprises a barrier 1 for dividing the inside of the refrigerator into a freezing chamber (F) and a refrigerating chamber (R), a main body 2 provided with a refrigerating cycle device for maintaining the freezing chamber (F) and the refrigerating chamber (R) at a low temperature, a freezing chamber door 4 rotatably connected to the main body 2 for opening and closing the freezing chamber (F), and a refrigerating chamber door 6 rotatably connected to the main body 2 for opening and closing the refrigerating chamber (R).

The refrigerating cycle device includes a compressor for compressing a refrigerant in a low-temperature and low-pressure state to a high-pressure state, a condenser for condensing the refrigerant in the high-pressure state compressed by the compressor by emitting heat to outdoor air, an expansion unit for decompressing the refrigerant condensed by the condenser, and an evaporator for evaporating the refrigerant expanded by the expansion unit by absorbing heat from the freezing chamber (F) and the refrigerating chamber (R).

Recently, an automatic ice-making device for making ice cubes from water by means of cool air in the freezing chamber (F) and then for exhausting the ice cubes is installed in the refrigerator.

FIG. 2 is a perspective view of the conventional refrigerator, in which a freezing chamber door and a refrigerating chamber door are opened.

As shown in FIG. 2, the automatic ice-making device includes an ice-maker 12 installed at an upper portion of the inside of the freezing chamber (F) for freezing water supplied thereto by means of cool air in the freezing chamber (F), an ice bank 14 installed in the freezing chamber (F) for containing ice cubes made by the ice-maker 12, a dispenser 16 installed at the freezing chamber door 4 for exhausting the ice cubes without opening the freezing chamber door 4, and an ice chute 18 for guiding the ice cubes contained in the ice bank 14 to drop to the dispenser 16.

FIG. 3 is a perspective view of an ice-maker for the conventional refrigerator. FIG. 4 is a sectional view of the ice-maker for the conventional refrigerator. FIG. 5 is a block diagram illustrating control for the ice-maker of the conventional refrigerator.

As shown in FIGS. 3 to 5, the ice-maker 12 includes a cup 21 for containing water supplied through a water supply hose (not shown) so as to supply the water, an ice-maker mold 22 for containing the water supplied from the cup 21 and freezing the water by means of cool air in the freezing chamber, a heater 23 installed at the ice-maker mold 22 for heating the ice-maker mold 22 so as to separate ice cubes from the ice-maker mold 22 when the ice cubes are exhausted, an ejector 24 rotatably arranged on an upper portion of the ice-maker mold 22 for drawing up the ice cubes, a motor 25 for generating driving force for rotating the ejector 24, a slider 26 for guiding the ice cubes drawn up by the ejector 24 into the ice bank 14, a full ice level sensing lever 27 for sensing a full ice level of the ice bank 14, and an ice-making controller 28 for controlling the heater 23 and the motor 25 according to the temperature of the ice-maker mold 22 and whether or not the ice bank 70 is at a full ice level and for controlling a water supply valve 21*a* for intermitting the water supplied into the cup 21.

An ice making space for allowing the water to be frozen is formed in the ice-maker mold 22, and a plurality of partition plates 22*a* for dividing the ice making space are provided in the ice making space so that a plurality of ice cubes are divisionally made.

Further, a connection part 22*b* fixed to a rear surface of the upper portion of the freezing chamber (F) is formed at the ice-maker mold 22.

The heater 23 is arranged on the bottom of the ice-maker mold 22.

The ejector 24 includes a rotary shaft 24*a* positioned at the upper portion of the ice making space and geared with the motor 25, and a plurality of pins 24*b* installed at the side wall of the shaft 24*a* and prepared in the same number as that of the units of the ice making space divided by the partition plates 22*a*.

The motor 25 is installed in the ice-making controller 28.

The ice-making controller 28 includes a temperature sensor 29*a* for sensing the temperature of the ice-maker mold 22, and a full ice level sensor 29*b* for detecting a rotating position of the full ice level sensing lever 22 and thus determining whether the ice bank 70 is at the full ice level.

Hereinafter, a control method of the above-described ice-maker will be described.

FIG. 6 is a flow chart illustrating the control method of the ice-maker for the conventional refrigerator.

As shown in FIG. 6, when power is inputted to the refrigerator, the ice-making controller 28 controls the motor 25 to set the ejector 24 to an initial position (A) (S1).

The ice-making controller 28 switches on the water supply valve 21*a* for a designated time and then switches off the water supply valve 21*a*, thereby allowing water, supplied from the outside during the time taken to switch on the water supply valve 21*a*, to be contained in the cup 21 and then to be transferred into the ice-maker mold 22 (S2).

Thereafter, the water contained in the ice-maker mold 22 is heat-exchanged with cool air in the freezing chamber (F) or the ice-maker mold 22, thereby being cooled and gradually frozen from at a portion thereof contacting the cool air or the ice-maker mold 22.

In case that the temperature of the ice-maker mold 22 sensed by the temperature sensor 29*a* is lower than a predetermined temperature (for example, −7° C.), the ice-making controller 28 determines that the ice-making is completed, and allows the heater 31 to be switched on for a predetermined time (for example, 2 minutes) and then to be switched off (S3 and S4).

By the switching-on of the heater, the temperature of the ice-maker mold 22 is raised, and the made ice cubes are melted at a portion thereof contacting the ice-maker mold 22 and are then separated from the ice-maker mold 22.

Thereafter, the ice-making controller 28 controls the motor 25 to rotate the ejector 24 from the initial position (A) to an ice-separating position (B), and then to return the ejector 24 to the initial position (A) (S5).

The ice cubes positioned in the ice-maker mold 22 are drawn up by the rotation of the ejector 24, and are dropped down to the slider 26. Then, the ice cubes are guided by the slider 26, and are transferred to the ice bank 14.

The ice-making controller 28 determines whether or not the ice bank 14 is at the full ice level by means of the sensing of the full ice level sensor 29*b* through the rotation of the full ice level sensing lever 22.

In case that it is determined that the ice bank 14 is not at the full ice level, the ice-making controller 28 controls the components to repeat the water supply, the ice-making, the heating, the ice separation, and the sensing of the full ice level, and in case that it is determined that the ice bank 14 is at the full ice level, the ice-making controller 28 stops the above series of steps, i.e., the water supply, the ice-making, the heating, the ice separation, and the sensing of the full ice level (S6).

Since the water supplied to the ice-maker mold 22 is cooled only by natural convection with the cool air in the freezing chamber (F) and the thermal conduction of the ice-maker mold 22, the above-described conventional ice-making control method of the ice-maker for the refrigerator is disadvantageous in that a time taken to make ice from the water is elongated.

SUMMARY OF THE INVENTION

Therefore, the present invention has been made in view of the above problems, and it is an object of the present invention to provide a quick ice-making control method of an ice-maker for a refrigerator, in which supplied water is stirred with an ejector for exhausting ice cubes so as to promote thermal transmission to the water, thereby quickly making ice from the water.

In accordance with one aspect of the present invention, the above and other objects can be accomplished by the provision of a quick ice-making control method of an ice-maker for a refrigerator comprising the steps of: (a) supplying water into an ice-maker mold; (b) quickly freezing the water by rotating an ejector for a predetermined time after the step (a); and (c) separating the obtained ice from the ice-maker mold in case that a temperature of the ice-maker mold is lower than a predetermined temperature after the step (b).

In accordance with another aspect of the present invention, there is provided a quick ice-making control method of an ice-maker for a refrigerator comprising the steps of: (a) supplying water into an ice-maker mold; (b) quickly freezing the water by rotating an ejector, and then stopping the rotation of the ejector in case that a temperature of the ice-maker mold is lower than a predetermined temperature after the step (a); and (c) separating the obtained ice from the ice-maker mold in case that the temperature of the ice-maker mold is lower than a second predetermined temperature after the step (b).

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 7:
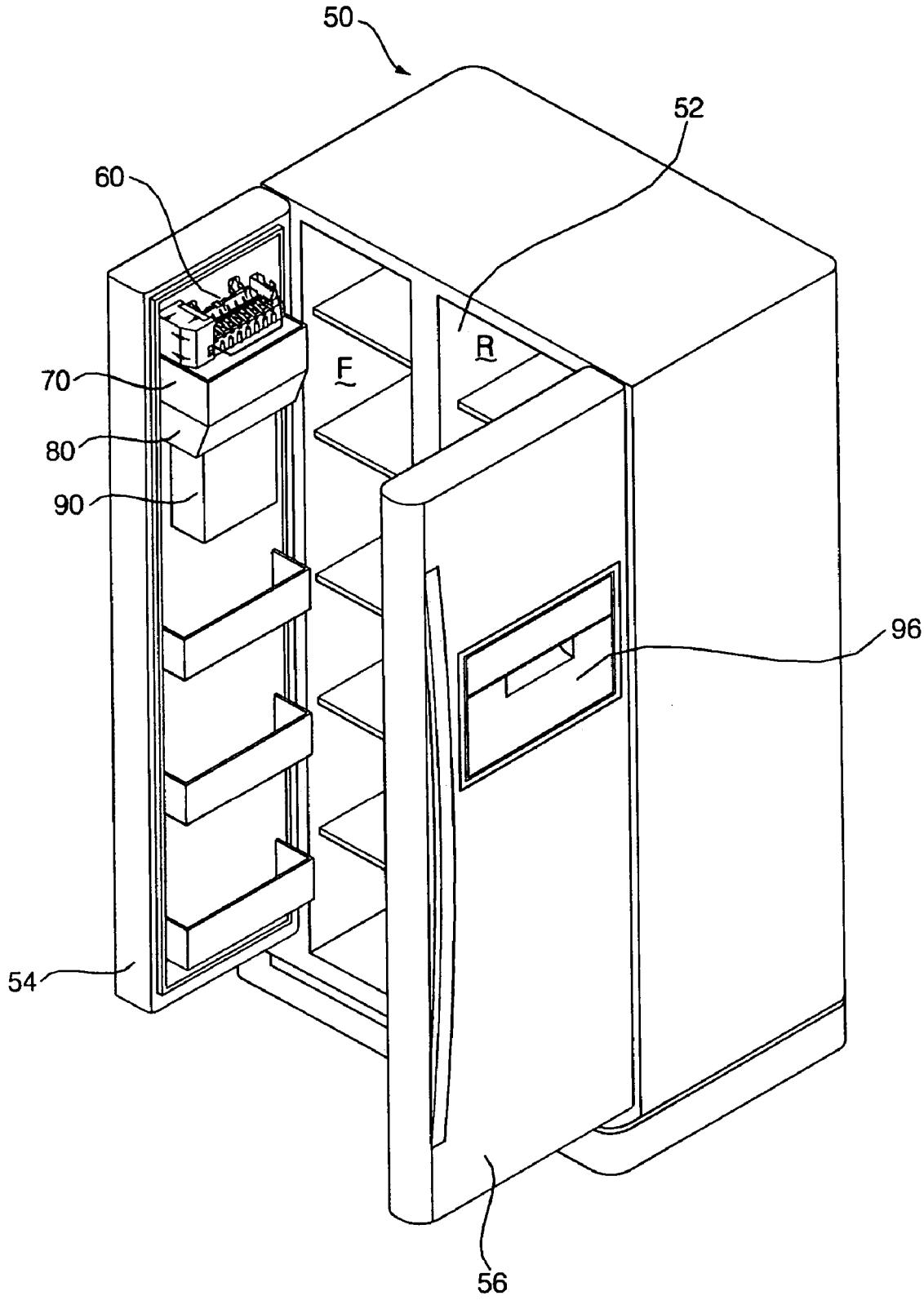
FIG. 7 is a perspective view of a refrigerator, in which a freezing chamber door and a refrigerating chamber door are opened, in accordance with the present invention.

FIG. 7 is a perspective view of a refrigerator, in which a freezing chamber door and a refrigerating chamber door are opened, in accordance with the present invention.

Figure 1:
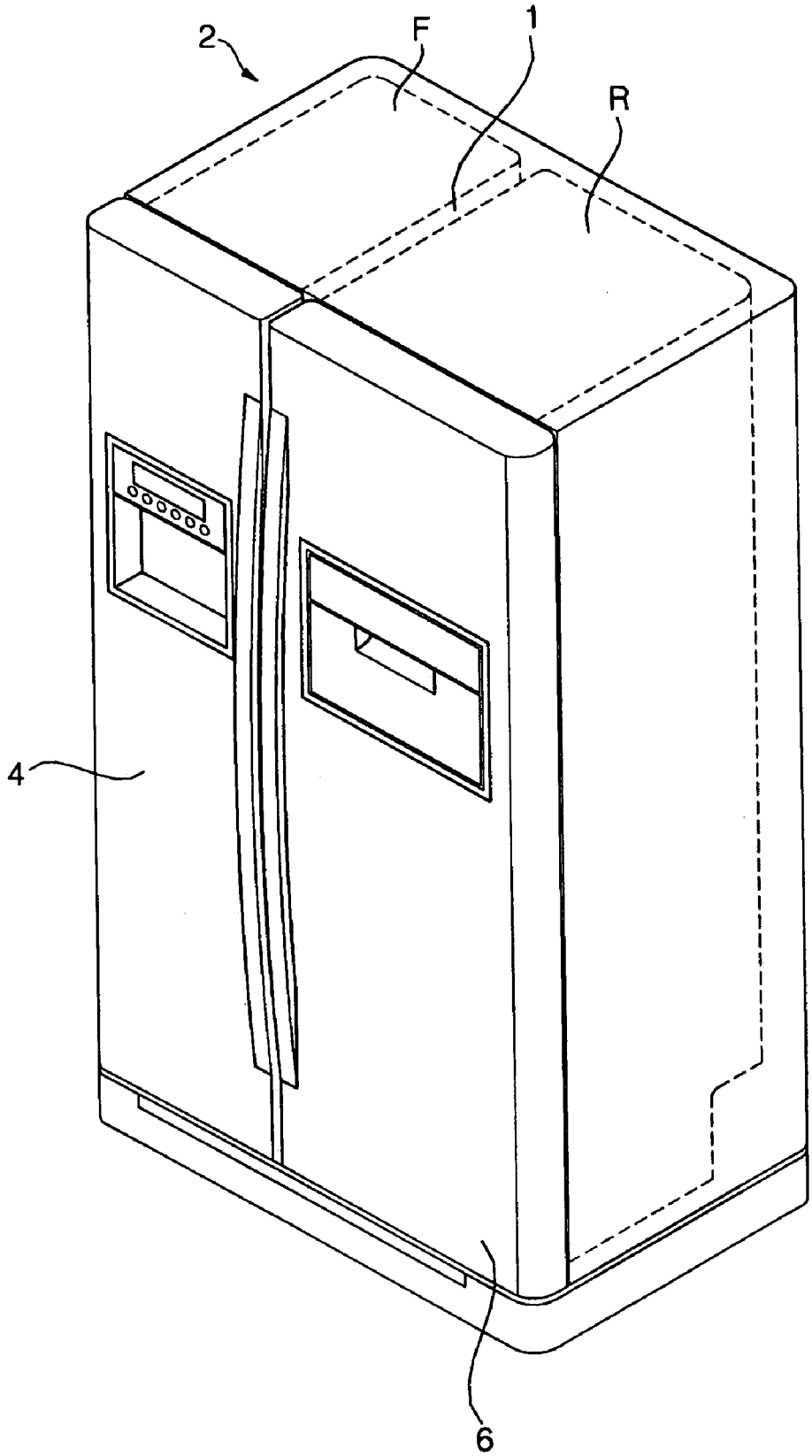
FIG. 1 (Prior Art)
FIG. 1 is a perspective view of a conventional refrigerator.
Figure 2:
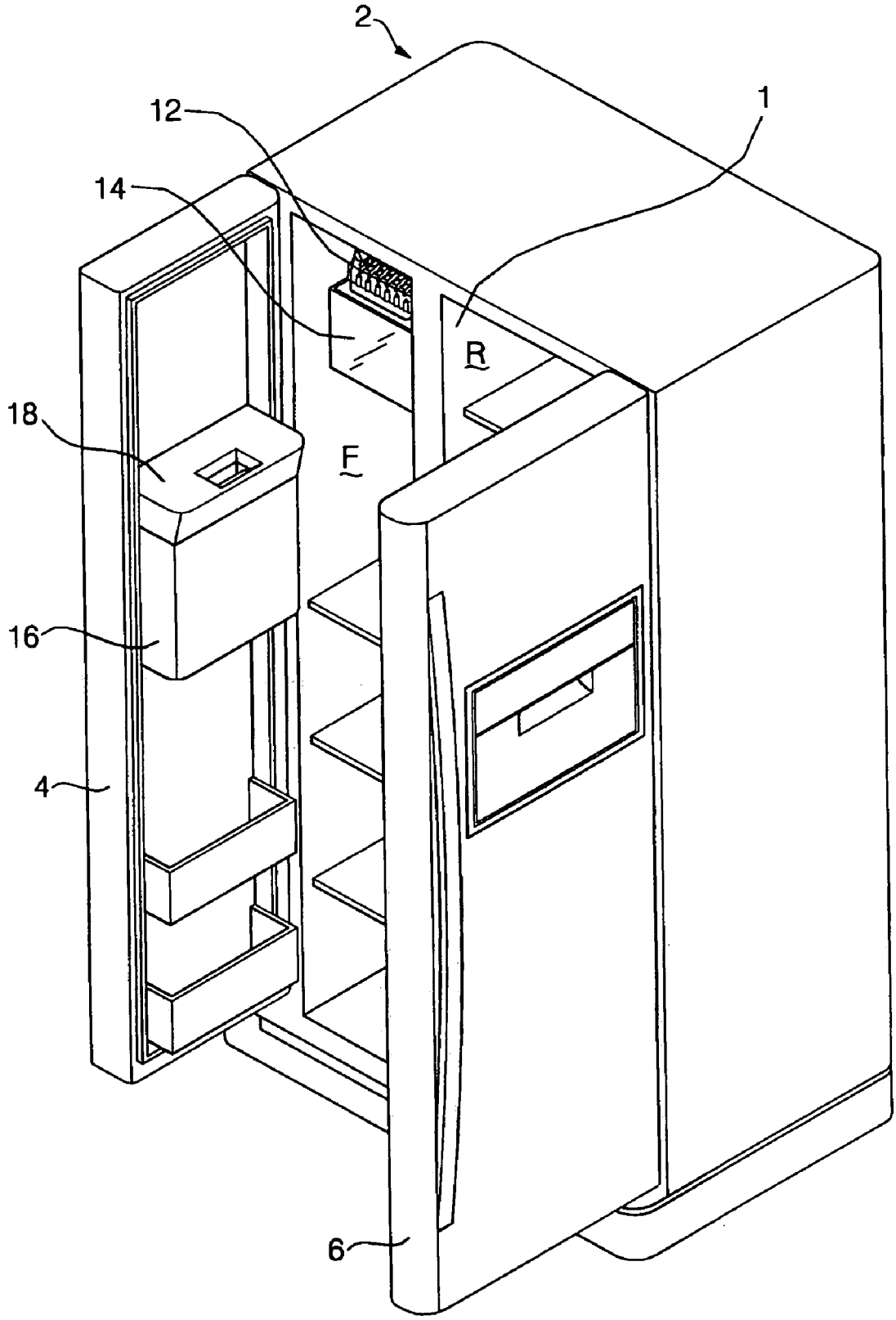
FIG. 2 (Prior Art)
FIG. 2 is a perspective view of the conventional refrigerator, in which a freezing chamber door and a refrigerating chamber door are opened.
Figure 3:
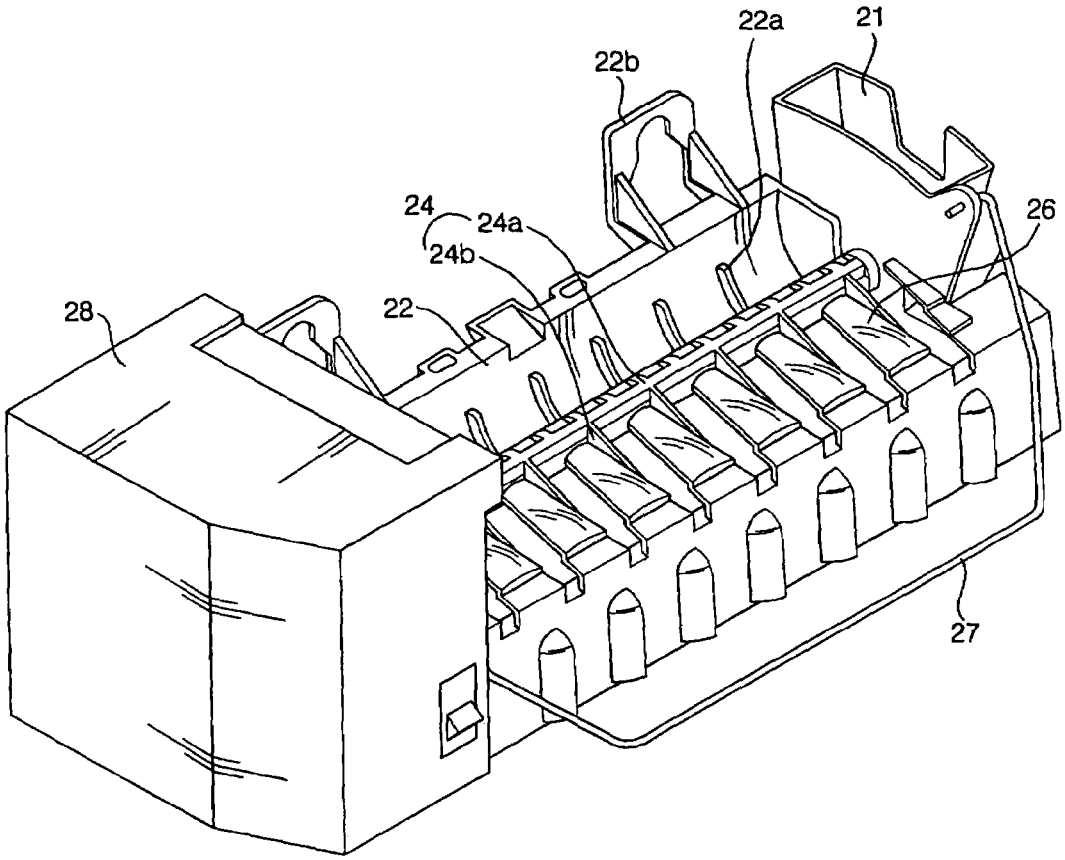
FIG. 3 (Prior Art)
FIG. 3 is a perspective view of an ice-maker for the conventional refrigerator.
Figure 4:
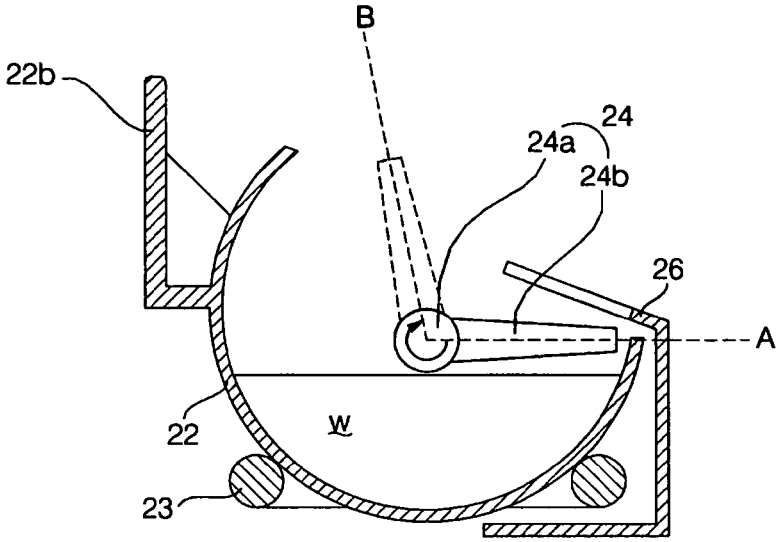
FIG. 4 (Prior Art)
FIG. 4 is a sectional view of the ice-maker for the conventional refrigerator.
Figure 5:
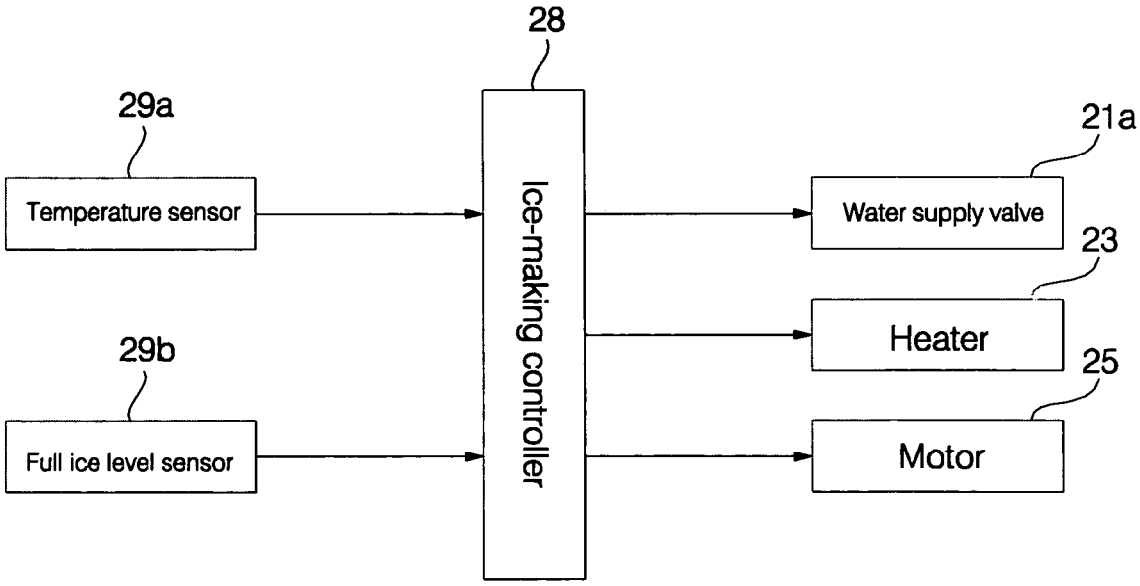
FIG. 5 (Prior Art)
FIG. 5 is a block diagram illustrating control of the ice-maker for the conventional refrigerator.
Figure 6:
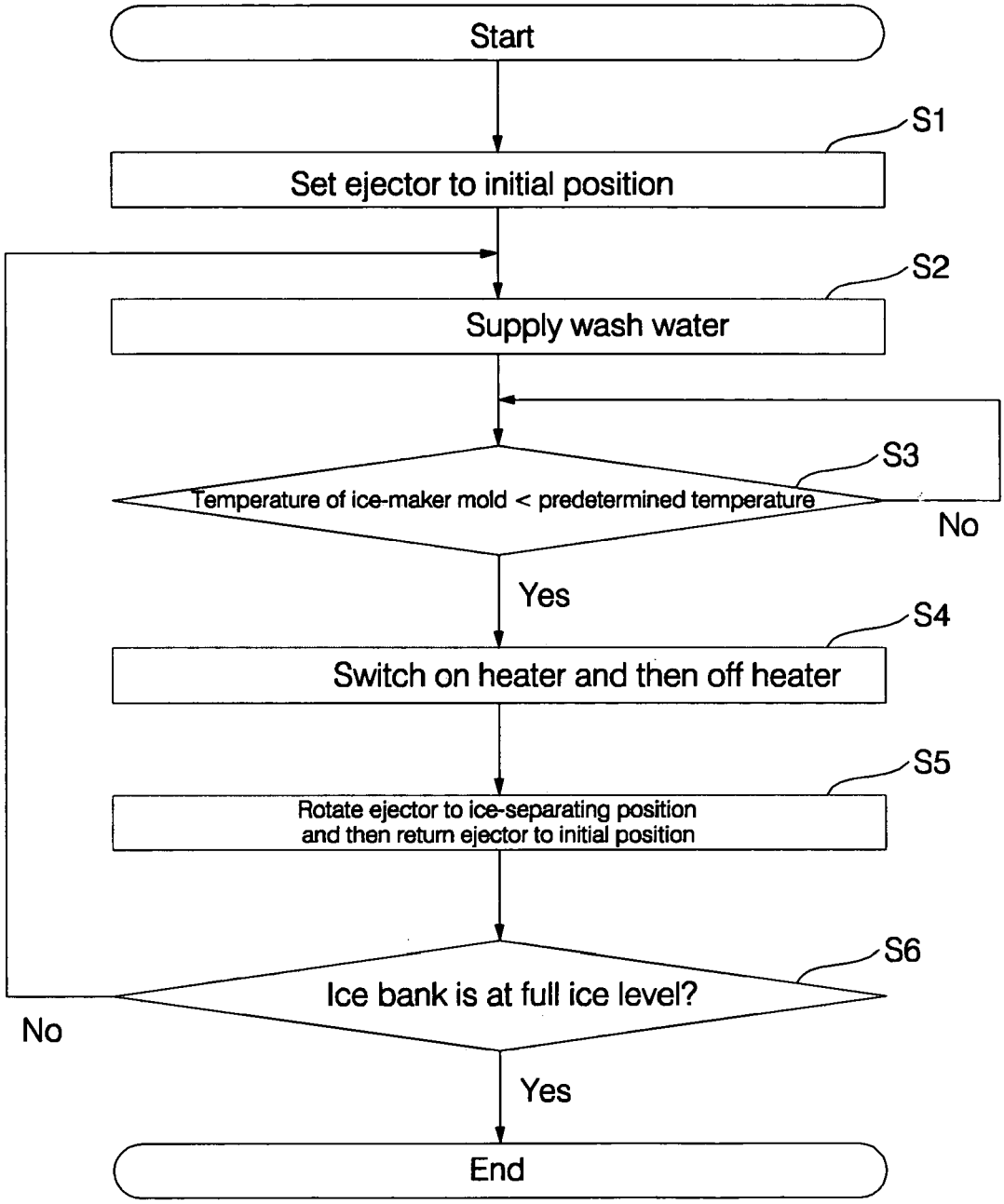
FIG. 6 (Prior Art)
FIG. 6 is a flow chart illustrating a control method of the ice-maker for the conventional refrigerator.

As shown in FIG. 1, the refrigerator in accordance with the present invention comprises a main body 50, a barrier 52 for dividing the inside of the main body 50 into a freezing chamber (F) and a refrigerating chamber (R), a freezing chamber door 54 rotatably connected to the main body 50 for opening and closing the freezing chamber (F), and a refrigerating chamber door 56 rotatably connected to the main body 50 for opening and closing the refrigerating chamber (R).

At the freezing chamber door 54, an ice-maker 60 for making ice by cooling water, an ice bank 70 for containing the ice cubes made by the ice-maker 60, an ice chute 80 serving as a passage for allowing the ice cues of the ice bank 70 to drop therethrough, and a dispenser 90 serving as a container for the ice cubes guided by the ice chute 80 or an object to be frozen.

The ice-maker 60 is installed at the rear surface of the freezing chamber door 54 so as to increase an effective volume of the freezing chamber (F).

The ice bank 70 is installed at the rear surface of the freezing chamber door 54 so as to increase the effective volume of the freezing chamber (F), and is positioned below the ice-maker 60.

The ice bank 70 includes an auger provided with an opened upper surface for horizontally carrying the ice made therein, a grinder for grinding the transferred ice, an ice outlet formed through the lower surface of the ice-maker 60 for exhausting the whole ice and the ground ice therethrough, and a shutter for opening and closing the ice outlet.

The ice chute 80 is installed at the rear surface of the freezing chamber door 54 such that the ice chute 80 is positioned under the ice bank 70.

An upper end of the ice chute 80 communicates with the ice outlet of the ice bank 70, and a lower end of the ice chute 80 communicates with the inside of the dispenser 90.

The dispenser 90 is installed at the freezing chamber door 54 such that the dispenser 90 is located under the ice chute 80, and is provided with an opened front surface through which a container for ice cubes comes into and out of the dispenser 90, and closed side and rear surfaces.

Here, non-described reference numeral 96 represents a home bar installed at the refrigerating chamber door 56.

Figure 8:
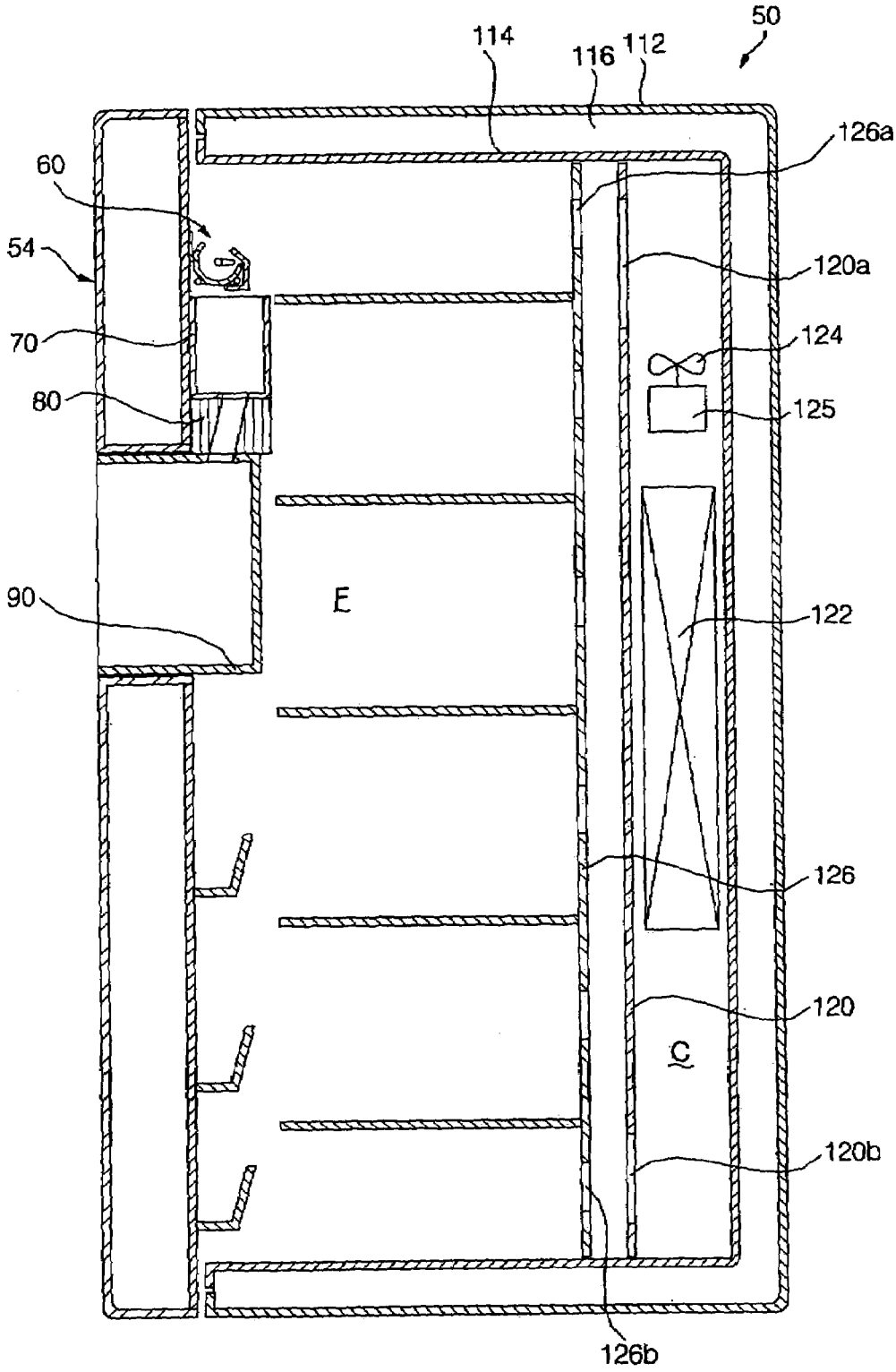
FIG. 8 is a longitudinal-sectional view of a freezing chamber of the refrigerator in accordance with the present invention.

FIG. 8 is a longitudinal-sectional view of the freezing chamber of the refrigerator in accordance with the present invention.

As shown in FIG. 8, the main body 50 includes an outer casing 112 defining an external appearance of the main body 50, a freezing chamber inner casing 114 installed in the outer casing 112, defining the freezing chamber (F) and provided with an opened front surface through which an object to be frozen enters and exits, and an insulating material 116 surrounding the outer circumference of the freezing chamber inner casing 114.

A cool air exhaust hole 120*a* and a cool air return hole 120*b* are formed in the rear surface of the freezing inner casing 114 in order to circulate cool air in the freezing chamber (F) or the refrigerating chamber therethrough, and a refrigerating chamber panel 120 for defining a cooling chamber (C) between the front surface of the refrigerating chamber panel 120 and the rear surface of the freezing inner casing 114 is disposed in the freezing inner casing 114.

An evaporator 122 for evaporating a refrigerant in a low-temperature and low-pressure state by passing the refrigerant is disposed in the cooling chamber (C), and a cooling fan 124 for blowing air heat-exchanged with the evaporator 122 into the refrigerating chamber (F) and the refrigerating chamber (F) is disposed in the cooling chamber (C).

The cooling fan 124 is axially connected to a motor 125 installed in the cooling chamber (C).

A freezing chamber rear panel 126 provided with a cool air exhaust hole 126*a* for supplying the air blown by the cooling fan 124 into the freezing chamber (F) and a cool air return hole 126*b* for returning the cool air of the freezing chamber (F) is disposed in front of the refrigerating chamber panel 120.

Figure 9:
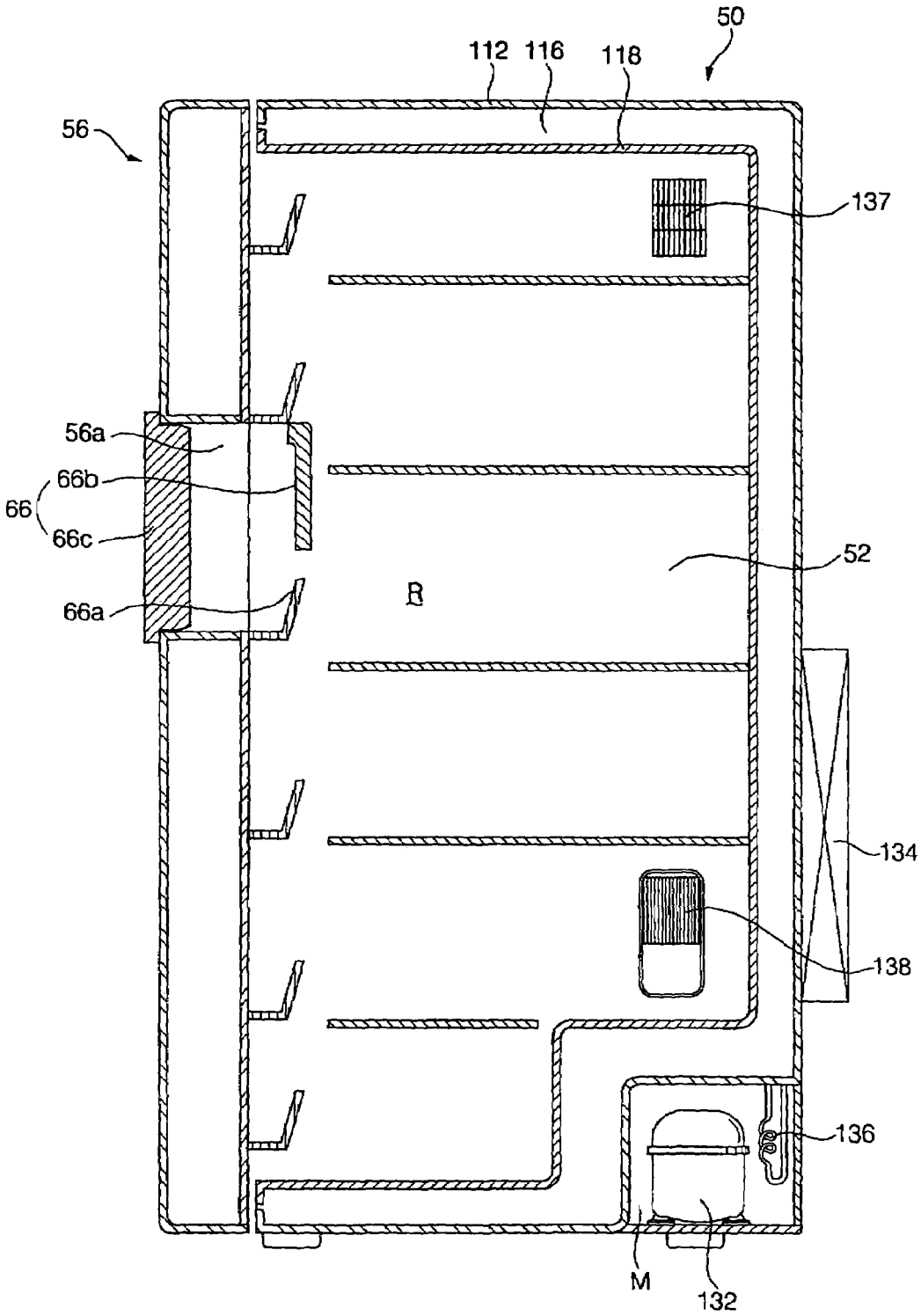
FIG. 9 is a longitudinal-sectional view of a refrigerating chamber of the refrigerator in accordance with the present invention.

FIG. 9 is a longitudinal-sectional view of the refrigerating chamber of the refrigerator in accordance with the present invention.

As shown in FIG. 9, the main body 50 includes a refrigerating chamber inner casing 118 installed in the outer casing 112, forming the refrigerating chamber (R) and provided with an opened front surface through which an object to be frozen enters and exits, the insulating material 116 surrounding the outer circumference of the refrigerating chamber inner casing 118, and a machinery chamber (M) positioned below the refrigerating chamber inner casing 118.

The main body 50 further includes a compressor 132 installed in the machinery chamber (M) for compressing the refrigerant in a low-temperature and low-pressure state evaporated by the evaporator 122, a condenser 134 installed in the machinery chamber (M) and installed at the rear surface of the outer casing 112 for condensing the refrigerant in the high-pressure state compressed by the compressor 132 by emitting heat from the refrigerant to outdoor air, and an expansion unit 136 for decompressing the refrigerant condensed by the condenser 134 so as to be easily evaporated.

The refrigerating chamber (R) includes a cool air Exhaust duct 137 installed above the barrier 52 for supplying the cool air cooled by the evaporator 122 into the refrigerating chamber (R), and a cool air return duct 138 installed below the barrier 52 for returning the cool air cooling the refrigerating chamber (R) to the cooling chamber (C).

One end of each of the cool air exhaust duct 137 and the cool air return duct 138 communicates with the refrigerating chamber (R), and the other end of each of the cool air exhaust duct 137 and the cool air return duct 138 communicates with a space between the refrigerating chamber panel and the freezing chamber rear panel or with the refrigerating chamber (R).

The home bar 66 includes a home bar bucket 66*a* installed at the rear surface of the refrigerating chamber door 56, a home bar cover 66*b* positioned above the home bar bucket 66*a*, and a home bar door 66*c* for opening and closing an opening 56*a* formed through the refrigerating chamber door 56.

Figure 10:
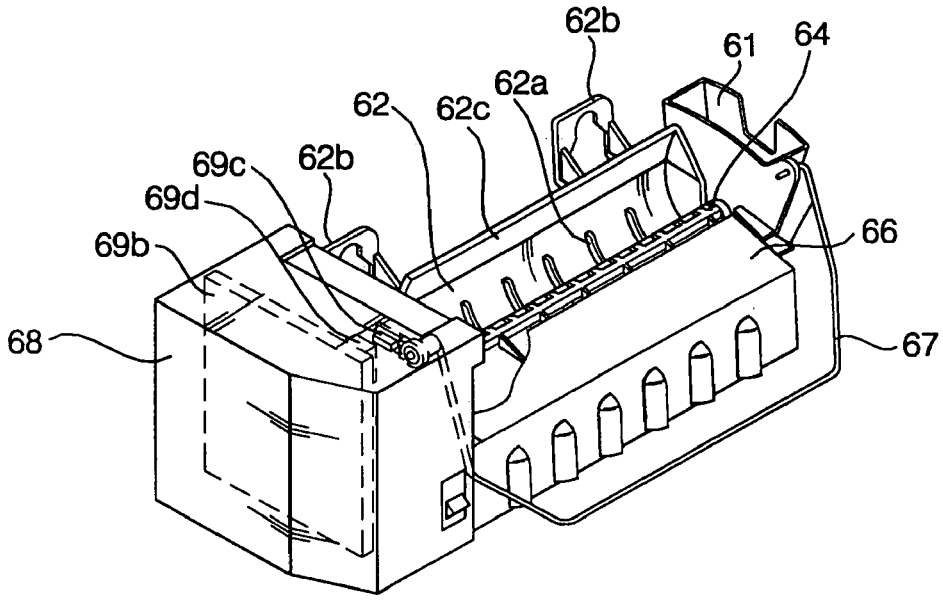
FIG. 10 is a perspective view of an ice-maker for the refrigerator in accordance with the present invention.
Figure 11:
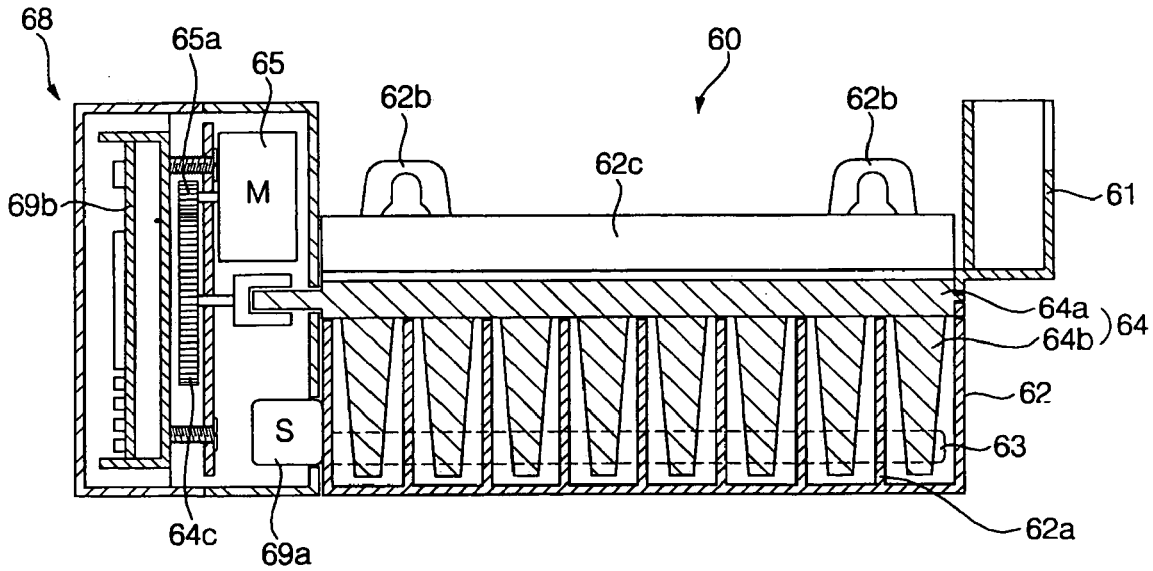
FIG. 11 is a cross-sectional view of the ice-maker for the refrigerator in accordance with the present invention.
Figure 12:
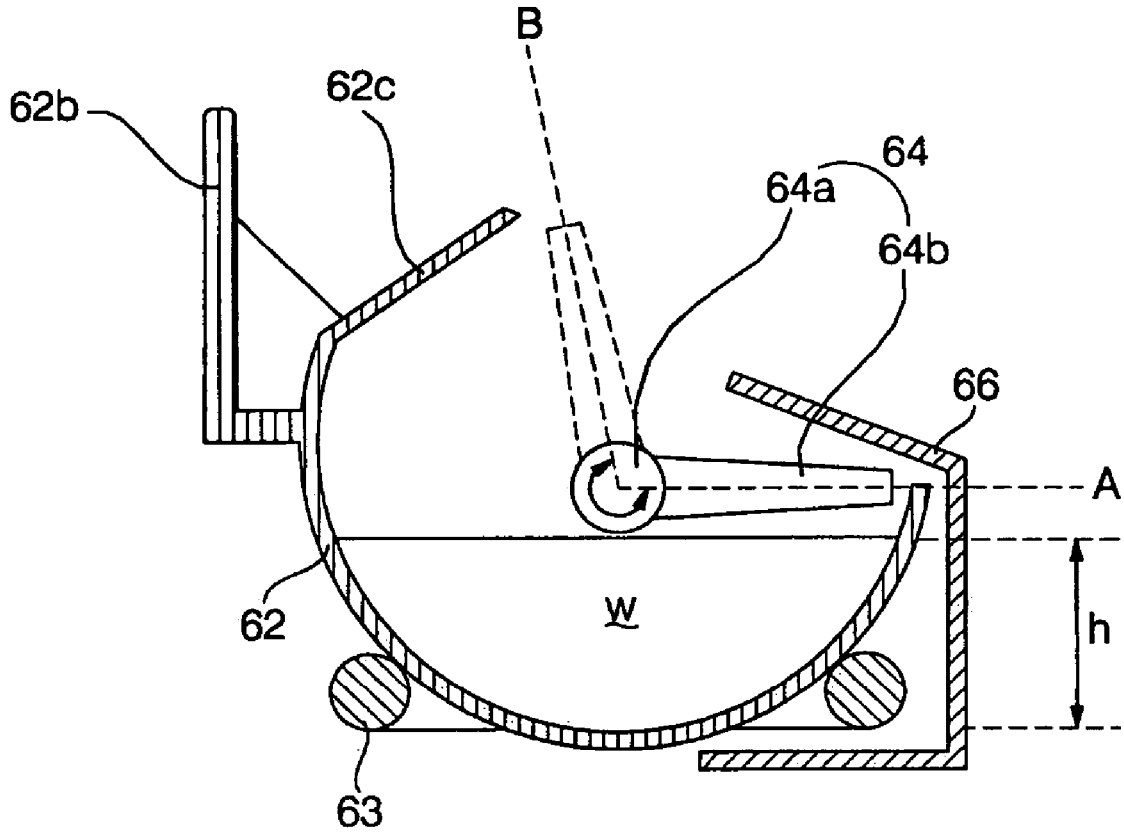
FIG. 12 is a longitudinal-sectional view of the ice-maker for the refrigerator in accordance with the present invention.

FIG. 10 is a perspective view of an ice-maker for the refrigerator in accordance with the present invention. FIG. 11 is a cross-sectional view of the ice make for the refrigerator in accordance with the present invention. FIG. 12 is a longitudinal-sectional view of the ice-maker for the refrigerator in accordance with the present invention.

As shown in FIGS. 10 to 12, the ice-maker 60 includes an ice-maker mold 62 installed at the rear surface of the freezing chamber door 54.

An ice making space having a semi-cylindrical shape in which water is frozen is longitudinally formed in the ice-maker mold 62, and a plurality of partition plates 62*a* for causing a plurality of ice cubes to be divisionally made are spaced from each other by a designated interval in the ice making space.

Further, connection portions 62*b* for fixing the ice-maker mold 62 to the rear surface of the freezing chamber door are respectively protruded from both sides of the upper portion of the front surface of the ice-maker mold 62, and an overflow prevention unit 62*c* is upwardly extended from the front surface of the ice-maker mold 62.

Water supplied through a water supply hose (not shown) is contained in the ice-maker mold 62, and a cup 61 for transferring the water into the ice making space of the ice-maker mold 62.

A heater 63 for heating the ice-maker mold 62 is installed on the bottom of the ice-maker mold 62 such that ice cubes are separated from the ice-maker mold 62.

The heater 63 having a "⊃" shape is positioned on the bottom of the ice-maker mold 62.

Further, a slider 66 for guiding ice cubes drawn up from the ice making space into the ice bank 70 is installed at the rear surface of the ice-maker mold 62.

The ice-maker 60 further includes an ejector 64 rotatably arranged on an upper portion of the ice-maker mold 62 for drawing up the ice cubes, a motor 65 for generating driving force for rotating the ejector 64, a full ice level sensing lever 67 for sensing a full ice level of the ice bank 70, and an ice-making controller 68 for controlling the heater 63 and the motor 65 according to the temperature of the ice-maker mold 62 and whether or not the ice bank 70 is at a full ice level and for controlling a water supply valve for intermitting the water supplied into the cup 61.

The ejector 64 includes a rotary shaft 64*a* geared with the motor 65 and longitudinally positioned at the upper portion of the ice making space, and a plurality of pins 64*b* installed at the side wall of the shaft 64*a* and prepared in the same number as that of the units of the ice making space divided by the partition plates 62*a*.

One end of the ejector 64 is rotatably supported on the cup 61, and the other end of the ejector 64 is protruded toward the inside of the ice-making controller 68 and connected to a rotary shaft of a driven gear 64*c* for receiving the driving force of the motor 65.

The motor 65 is installed in the ice-making controller 68, and a driving gear 65*a* interdigitated with the driven gear 64*c* is installed at the rotary shaft.

The ice-making controller 68 includes a temperature sensor 69*a* for sensing the temperature of the ice-maker mold 62, a full ice level sensor for detecting a rotating position of the full ice level sensing lever 66 and thus determining whether the ice bank 70 is at the full ice level, and a control panel 69*b* for switching on/off the heater 63, the motor 65 and the water supply valve according to the temperature sensed by the temperature sensor 69*a* and whether or not the ice bank 70 is at the full ice level sensed by the full ice level sensor.

The full ice level sensor includes a magnet 69*c* rotated and geared with the full ice level sensing lever 67, and a hall sensor 69*d* fixed to the control panel 69*b* for sensing the variation of a magnetic field when the magnet 69*c* moves.

Non-described reference mark w denotes the water contained in the ice making space of the ice-maker mold 62.

Hereinafter, an operation of the above-described refrigerator will be described in detail.

First, when the compressor 132 is operated, the compressor 132 discharges a refrigerant in a high-temperature and high-pressure gaseous state, and the discharged refrigerant in the high-temperature and high-pressure gaseous state passes through the condenser 134 such that the refrigerant is condensed into a mid-temperature and high-pressure liquid state by heat-exchanging with outdoor air around the condenser 134. Then, the refrigerant in the high-pressure liquid state passes through the expansion unit 136 such that the refrigerant is expanded into a low-temperature and low-pressure liquid state. The refrigerant expanded by the expansion unit 136 passes through the evaporator 122, thereby cooling peripheral air.

When the cooling fan 124 is operated, the refrigerant cooled by the evaporator 122 is circulated into the cooling chamber (C), the freezing chamber (F) and the refrigerating chamber (R), thereby maintaining the freezing chamber (F) and the refrigerating chamber (R) at a low temperature.

A part of cool air circulated into the freezing chamber (F) cools the ice-maker 60 at the rear surface of the freezing chamber door 54 so that ice is made from the water supplied into the ice-maker 60, and the ice is contained by the ice bank 70.

Hereinafter, a quick ice-making control method of the above-described ice-maker for the refrigerator will be described in detail.

Figure 13:
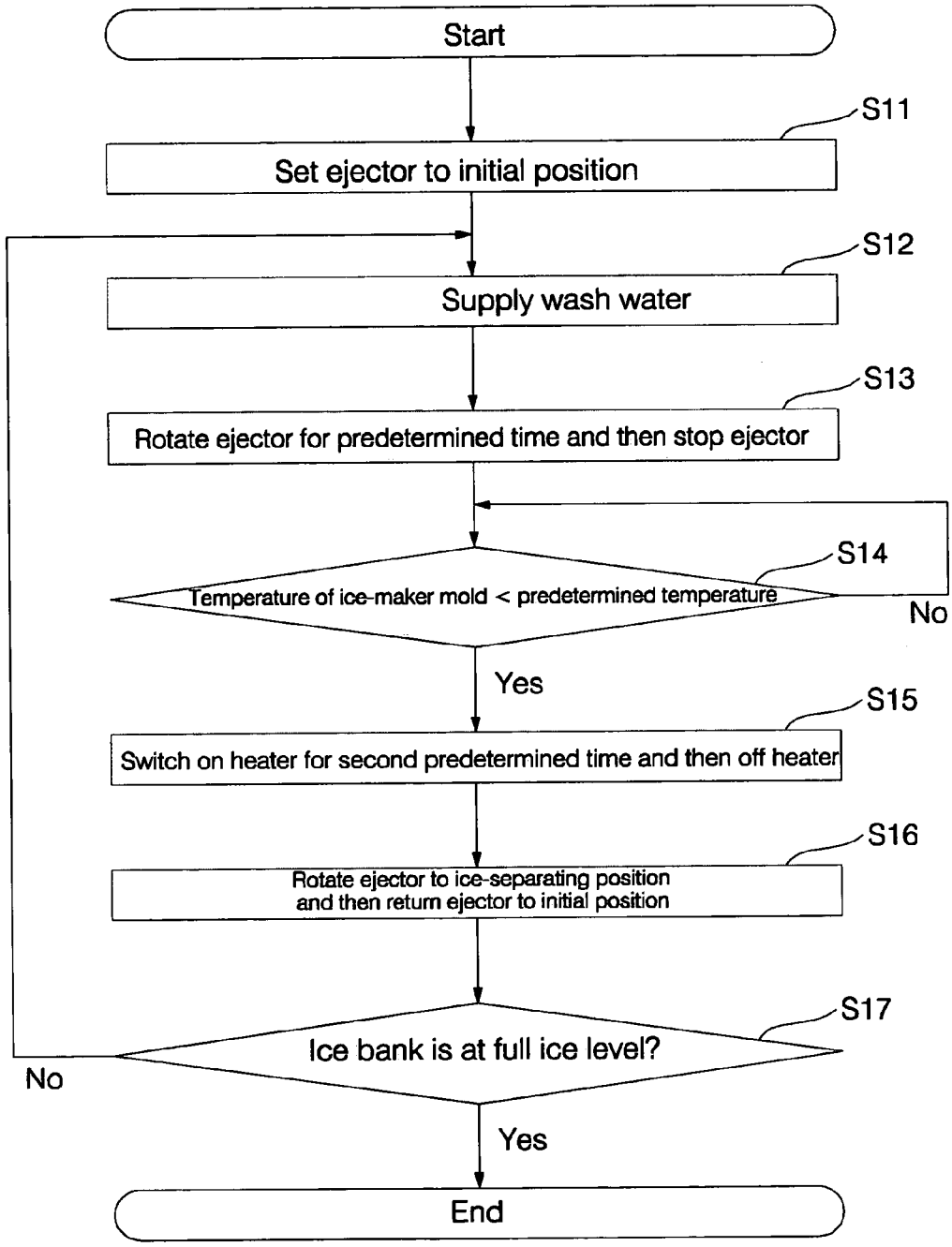
FIG. 13 is a flow chart illustrating a quick ice-making control method of the ice-maker for the refrigerator in accordance with a first embodiment of the present invention.

FIG. 13 is a flow chart illustrating a quick ice-making control method of the ice-maker for the refrigerator in accordance with a first embodiment of the present invention.

First, when power is inputted to the refrigerator, the ice-making controller 68 controls the motor 65 to set the ejector 64 to an initial position (A) (S11).

The ice-making controller 68 switches on the water supply valve intermitting the water supplied to the cup 61 for a designated time, and then switches off the water supply valve (S12).

The water supplied from the outside during the time taken to switch on the water supply valve is contained in the cup 61, and is then transferred into the ice-maker mold 62.

Thereafter, the water contained in the ice-maker mold 62 is heat-exchanged with cool air in the freezing chamber (F) or the ice-maker mold 62, thereby being cooled and gradually frozen from at a portion thereof contacting the cool air or the ice-maker mold 62.

The ice-making controller 68 rotates the ejector 64 for a predetermined time (for example, 1 minute) during the freezing of the water, thereby promoting the freezing of the water (S13).

That is, the ejector 64 serves to stir the water prior to the freezing of the water so as to promote convection of the water, the thermal transmission between the cool air and the water is promoted by means of the forcible convection of the water, thus allowing the water to be quickly cooled.

Here, the rotation of the ejector 64 is achieved such that the pins 64*b* of the ejector 64 agitate the water in the range of a predetermined angle (for example, 10° to 250°).

The rotation of the ejector 64 is achieved such that the pins 64*b* of the ejector 64 agitate the water in the range of the predetermined angle (for example, 10° to 250°), the upper limit of the positions of the pins 64*b* of the ejector 64 is higher or lower than the level of the supplied water, and the above angle of the predetermined angle is a predetermined agitation angle of the pins 64*b* of the ejector 64.

Figure 14:
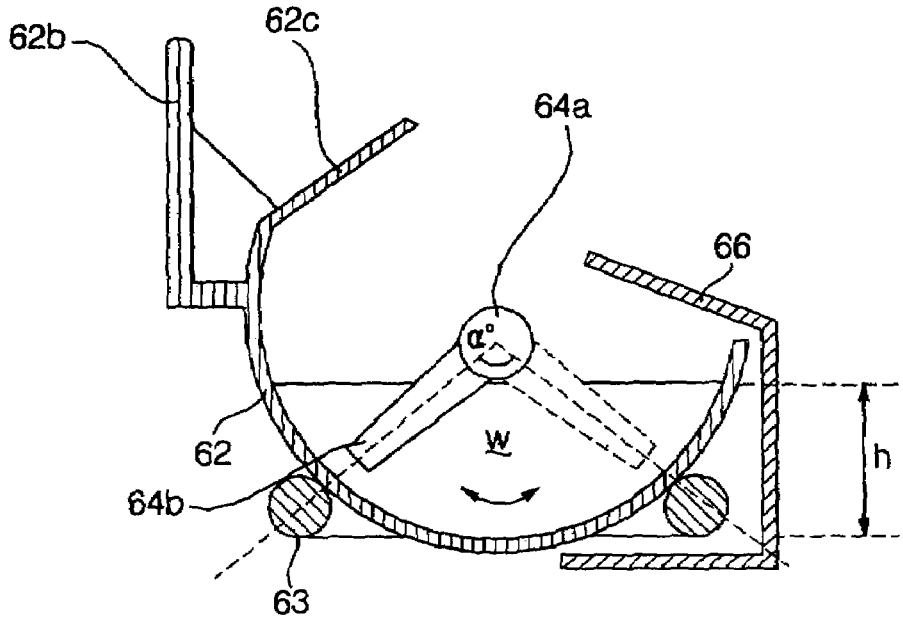
FIG. 14 is a longitudinal-sectional view of one example of an ice-maker in which an ejector is rotated to achieve a stirring function.

FIG. 14 is a longitudinal-sectional view of one example of the ice-maker in which the ejector is rotated to achieve a stirring function.

As shown in FIG. 14, in case that the predetermined agitation angle of the pins 64*b* of the ejector 64 is small (for example, 10° to 170°), the ejector 64 is rotated such that the water is stirred by the pins 64*b* under the condition that the upper limit of the positions of the pins 64*b* is lower than the level (h) of the supplied water (w).

Figure 15:
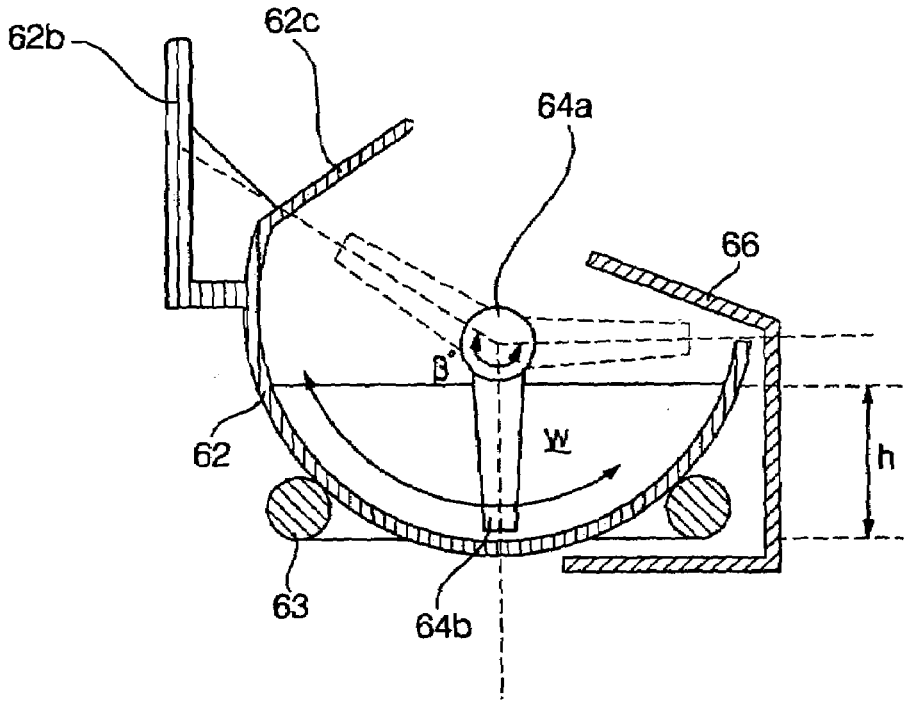
FIG. 15 is a longitudinal-sectional view of another example of an ice-maker in which an ejector is rotated to achieve a stirring function.

FIG. 15 is a longitudinal-sectional view of another example of the ice-maker in which the ejector is rotated to achieve a stirring function.

As shown in FIG. 15, in case that the predetermined agitation angle of the pins 64*b* of the ejector 64 is large (for example, 180° to 250°), the ejector 64 is rotated such that the water is stirred by the pins 64*b* under the condition that the upper limit of the positions of the pins 64*b* is higher than the level (h) of the supplied water (w).

The rotation of the ejector 64 is not limited to the agitation of the pins 64*b*, but may be continuously made by the continuous rotation of the pins 64*b* in one direction.

Further, in order to improve thermal transmission of the water, it is possible to rotate the ejector 64 during the stirring of the water at a speed higher than that of the ejector 64 during the drawing up of the ice.

Figure 16:
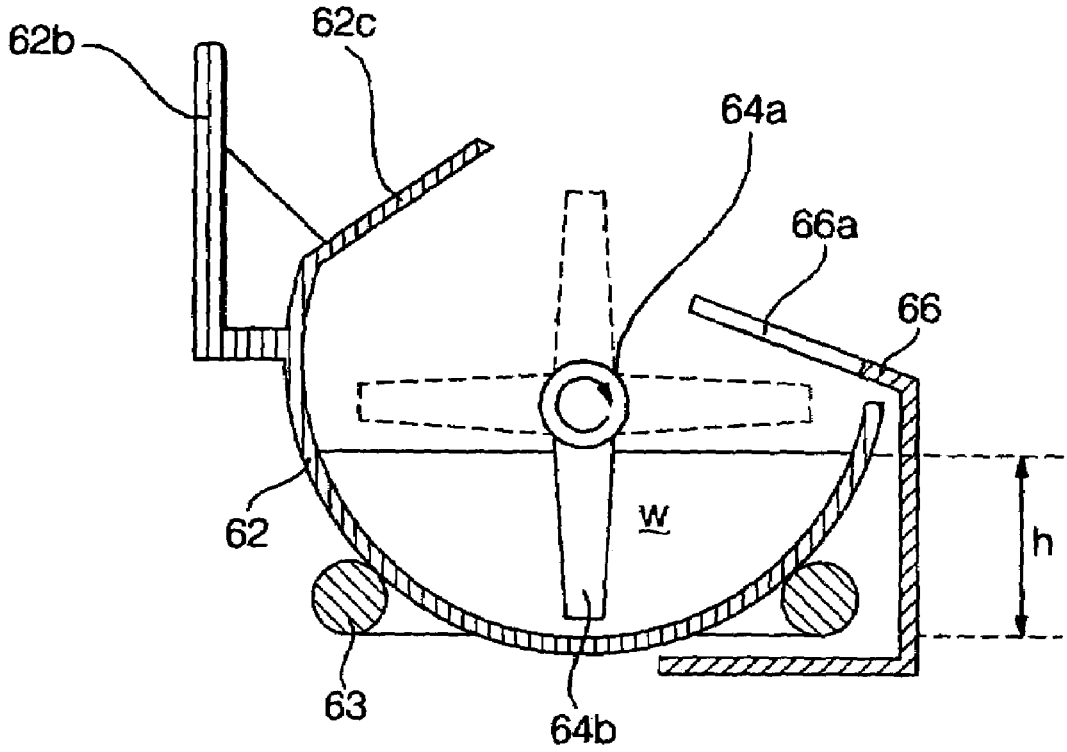
FIG. 16 is a longitudinal-sectional view an ice-maker in which an ejector is continuously rotated in one direction.

FIG. 16 is a longitudinal-sectional view an ice-maker in which an ejector is continuously rotated in one direction.

As shown in FIG. 16, in case that the ejector 64 is continuously rotated in one direction, the pins 64*b* of the ejector 64 are rotated to stir the water.

Here, non-described reference numeral 66*a* represents a shelter groove formed in the slider 66 for preventing the pins 64*b* from interfering with the slider 66 during the continuous rotation of the ejector 64 in one direction.

In case that the temperature of the ice-maker mold 62 sensed by the temperature sensor 69*a* after the rotation of the ejector 64 for a predetermined time (for example, 1 minute) is lower than a predetermined temperature (for example, −7° C.), the ice-making controller 68 determines that the ice making is completed, and switches on the heater 63 and then switches off the heater 63 after a second predetermined time (for example, 2 minutes) from the switching-on of the heater 63 elapses (S14 and S15).

By the switching-on of the heater 63, the temperature of the ice-maker mold 62 is raised, and the made ice is melted at a portion thereof contacting the ice-maker mold 62 and is then separated from the ice-maker mold 62.

Thereafter, the ice-making controller 68 controls the motor 65 to rotate the ejector 64 from the initial position (A) to an ice-separating position (B), and then to return the ejector 24 to the initial position (A) (S16).

The ice positioned in the ice-maker mold 62 is drawn up by the rotation of the ejector 64, and is dropped to the slider 66. Then, the ice is guided by the slider 66, and is transferred to the ice bank 64.

Thereafter, the ice-making controller 68 determines whether or not the ice bank 70 is at the full ice level by means of the sensing of the full ice level sensor 69*b* through the rotation of the full ice level sensing lever 67 (S17).

In case that it is determined that the ice bank 70 is not at the full ice level, the ice-making controller 68 controls the components to repeat the water supply, the quick ice-making, the heating, the ice separation, and the sensing of the full ice level.

In case that it is determined that the ice bank 70 is at the full ice level, the ice-making controller 68 steps the above series of the steps, i.e., the water supply, the quick ice-making, the heating, the ice separation, and the sensing of the full ice level, the steps after the water supply in order to rapidly supply the ice after the recession of the full ice level of the ice bank 70, or the steps after the quick ice-making.

The present invention is not limited to the above embodiment, and the switching-off of the heater 63 is not controlled according to the second predetermined time (for example, 2 minutes) from the switching-on of the heater 63 but may be controlled according to the temperature of the ice-maker mold 62.

That is, in case that the temperature of the ice-maker mold 62 is less than a predetermined temperature (for example, −7° C.), the ice-making controller 68 can switch on the heater 63, and then switch off the heater 63 when the temperature of the ice-maker mold 62 reaches a second predetermined temperature (for example, −2° C.) higher than the predetermined temperature (for example, −7° C.).

Further, the ice controller 68 can switch off the heater 63 when the ejector 64 reaches a predetermined position in the ice-maker mold 62.

Figure 17:
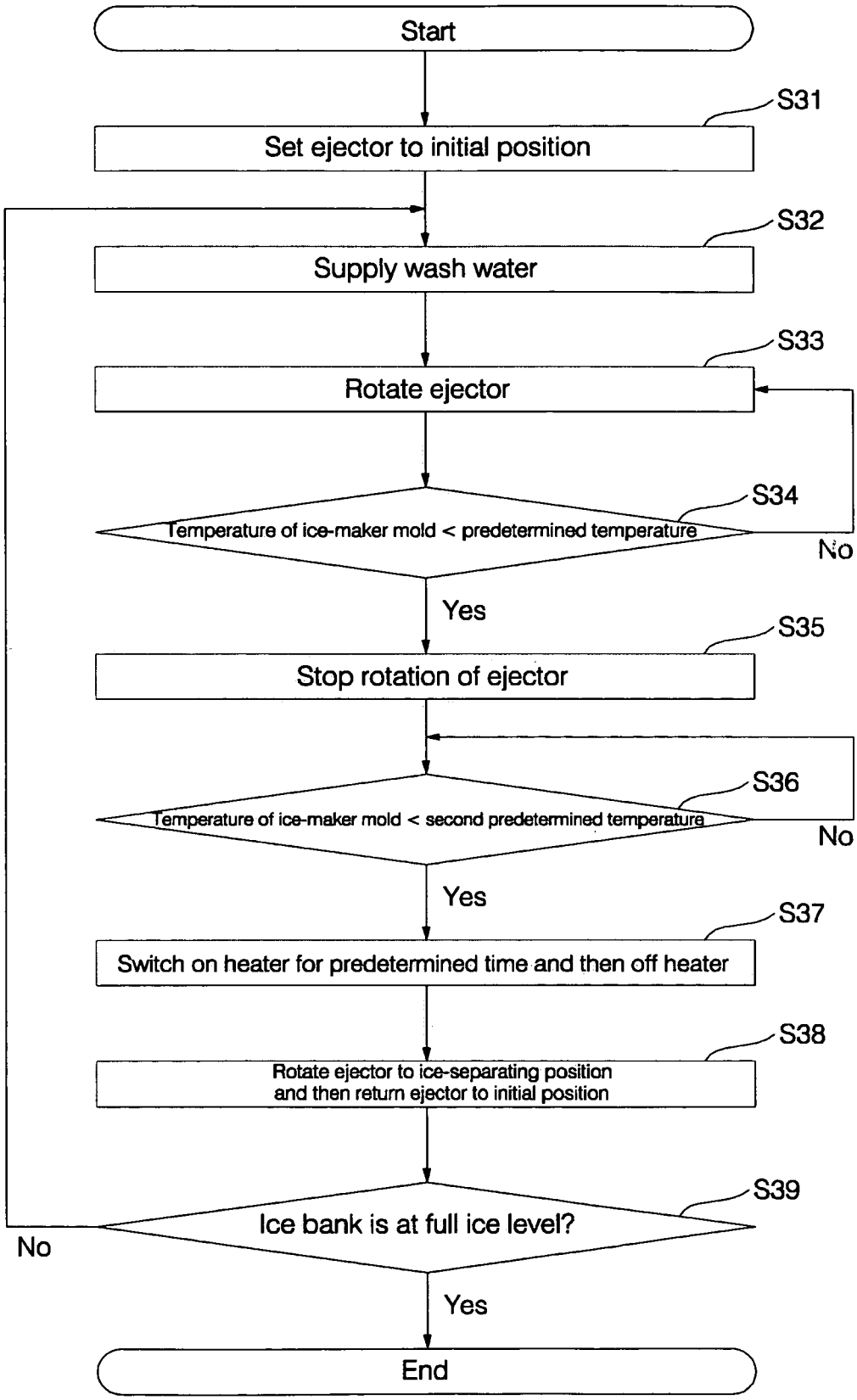
FIG. 17 is a flow chart illustrating a quick ice-making control method of the ice-maker for the refrigerator in accordance with a second embodiment of the present invention.

FIG. 17 is a flow chart illustrating a quick ice-making control method of the ice-maker for the refrigerator in accordance with a second embodiment of the present invention.

First, when power is inputted to the refrigerator, the ice-making controller 68 controls the motor 65 to set the ejector 64 to an initial position (A) (S31).

The ice-making controller 68 switches on the water supply valve (not shown) intermitting the water supplied to the cup 61 for a designated time, and then switches off the water supply valve (S32).

The water supplied from the outside during the time taken to switch on the water supply valve is contained in the cup 61, and is then transferred into the ice-maker mold 62.

Thereafter, the water contained in the ice-maker mold 62 is heat-exchanged with cool air in the freezing chamber (F) or the ice-maker mold 62, thereby being cooled and gradually frozen from at a portion thereof contacting the cool air or the ice-maker mold 62.

The ice-making controller 68 rotates the ejector 64 during the freezing of the water, thereby promoting the freezing of the water (S33).

Hereinafter, the rotation of the ejector 64 and the promotion of the ice making thereby in the second embodiment are the same as those in the first embodiment, and thus detailed descriptions thereof will be omitted.

In case that the temperature of the ice-maker mold 62 is lower than a predetermined temperature (for example, 1° C.), the ice-making controller 68 stops the rotation of the ejector 64 (S34 and S35).

Here, the predetermined temperature (for example, 1° C.) denotes the temperature of the ice-maker mold 62 just before the freezing of the water contained in the ice-maker mold 62. Preferably, the predetermined temperature has a value determined by experimentation.

In case that the temperature of the ice-maker mold 62 is lower than a second predetermined temperature (for example, −7° C.) sensed by the temperature sensor 69*a* after the rotation and stoppage of the ejector 64, the ice-making controller 68 determines that the ice making is completed, and switches on the heater 63 and then switches off the heater 63 after a predetermined time (for example, 2 minutes) from the switching-on of the heater 63 (S36 and S37).

By the switching-on of the heater 63, the temperature of the ice-maker mold 62 is raised, and the made ice is melted at a portion thereof contacting the ice-maker mold 62 and is then separated from the ice-maker mold 62.

Thereafter, the ice-making controller 68 controls the motor 65 to rotate the ejector 64 from the initial position (A) to an ice-separating position (B), and then to return the ejector 24 to the initial position (A) (S38).

The ice positioned in the ice-maker mold 62 is drawn up by the rotation of the ejector 64, and is dropped to the slider 66. Then, the ice is guided by the slider 66, and is transferred to the ice bank 64.

Thereafter, the ice-making controller 68 determines whether or not the ice bank 70 is at the full ice level by means of the sensing of the full ice level sensor 69*b* through the rotation of the full ice level sensing lever 67 (S39).

In case that it is determined that the ice bank 70 is not at the full ice level, the ice-making controller 68 controls the components to repeat the water supply, the quick ice-making, the heating, the ice separation, and the sensing of the full ice level.

In case that it is determined that the ice bank 70 is at the full ice level, the ice-making controller 68 stops the above series of the steps, i.e., the water supply, the quick ice-making, the heating, the ice separation, and the sensing of the full ice level, the steps after the water supply in order to rapidly supply the ice after the recession of the full ice level of the ice bank 70, or the steps after the quick ice-making.

The present invention is not limited to the above embodiment, and the switching-off of the heater 63 is not controlled according to the second predetermined time (for example, 2 minutes) from the switching-on of the heater 63 but may be controlled according to the temperature of the ice-maker mold 62.

That is, in case that the temperature of the ice-maker mold 62 is less than a predetermined temperature (for example, −7° C.), the ice-making controller 68 can switch on the heater 63, and then switch off the heater 63 when the temperature of the ice-maker mold 62 reaches a second predetermined temperature (for example, −2° C.) higher than the predetermined temperature (for example, −7° C.).

Further, the ice controller 68 can switch off the heater 63 when the ejector 64 reaches a predetermined position in the ice-maker mold 62.

The refrigerator in accordance with the present invention has several advantages, as follows.

First, since the ejector is rotated for a predetermined time so that water in the ice-maker mold is stirred by the ejector after the water is supplied to the ice-maker mold, it is possible to promote the cooling of the water. Further, since the ejector separates obtained ice from the ice-maker mold in case that the temperature of the ice-maker mold is lower than a predetermined temperature after the rotation of the ejector is stopped, it is possible to rapidly freeze the water.

Second, since the ejector is rotated after the water is supplied to the ice-maker mold and is then stopped in case that the temperature of the ice-maker mold is lower than a predetermined temperature, and the ejector separates the obtained ice from the ice-maker mold in case that the temperature of the ice-maker mold is lower than a second predetermined temperature after the rotation of the ejector is stopped, it is possible to accelerate the cooling of the water just before the water is frozen, and to rapidly freeze the water.

Third, since the ejector is agitated in the range of predetermined angles so as to activate water current, it is possible to rapidly cool the water.

Fourth, the range of the predetermined angles is designated such that the upper agitation limit of pins of the ejector is higher than the level of the supplied water, thereby allowing the pins rising above the water to be cooled by cool air of the freezing chamber then to be immersed in the water, thus promoting the thermal transmission between the cool air and the water, and rapidly freezing the water.

Fifth, the range of the predetermined angles is designated such that the upper agitation limit of pins of the ejector is lower than the level of the supplied water, thereby increasing the agitation speed of the pins and the convection of the water, thus rapidly freezing the water.

Sixth, since the ejector is continuously rotated such that the pins rising above the water are cooled by cool air of the freezing chamber and are then immersed in the water, it is possible to promote the thermal transmission between the cool air and the water, to simplify the control of the method, and to lengthen the life span of the motor compared to the case that the ejector is agitated.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An ice-making control method for an ice-maker for a refrigerator comprising:

supplying water into an ice-maker mold;

rotating an ejector for a first predetermined time such that the water supplied into the ice-maker mold is agitated to be frozen quickly;

switching on a heater to separate an obtained ice from the ice-maker mold and then switching off the heater;

rotating the ejector so that the obtained ice is ejected from the ice-maker mold; and returning the ejector to an initial position.

2. The ice-making control method as set forth in claim 1, wherein, in rotating an ejector for a first predetermined time, the ejector is rotated within a predetermined angular range.

3. The ice-making control method as set forth in claim 2, wherein the predetermined angular range is designated such that an upper rotation limit of pins of the ejector is higher than a level of the supplied water.

4. The ice-making control method as set forth in claim 2, wherein the predetermined angular range is designated such that an upper rotation limit of pins of the ejector is lower then a level of the supplied water.

5. The ice-making control method as set forth in claim 1, wherein, in rotating an ejector for a first predetermined time, the ejector is rotated in one direction.

6. The ice-making control method as set forth in claim 1, wherein a rotational speed of the ejector when rotating an ejector for a first predetermined time is higher than that of the ejector when rotating the ejector so that the obtained ice is ejected from the ice-maker mold.

7. The ice-making control method as set forth in claim 1, wherein the heater is switched on when a temperature of the ice-maker mold is lower than a predetermined temperature, and is then switched off when a second predetermined time elapses.

8. The ice-making control method as set forth in claim 1, wherein the heater is switched on when a temperature of the ice-maker mold is lower than a first predetermined temperature, and is then switched off when the temperature of the ice-maker mold reaches a second predetermined temperature higher than the first predetermined temperature.

9. The ice-making control method as set forth in claim 1, wherein the heater is switched off when the ejector reaches a predetermined position.

10. The ice-making control method as set forth in claim 1, further comprising:

sensing whether the ejected ice reaches a full ice level after rotating the ejector so that the obtained ice is ejected from the ice-maker mold, wherein subsequent to supplying water into an ice-maker mold, the method is stopped when it is determined that the ejected ice reaches a full ice level when rotating the ejector so that the obtained ice is ejected from the ice-maker mold.

11. An ice-making control method for an ice-maker for a refrigerator, comprising:

supplying water into an ice-maker mold;

rotating an ejector such that the water supplied into the ice-maker mold is agitated to be frozen quickly, and then stopping the rotation of the ejector when a temperature of the ice-maker mold is lower than a predetermined temperature;

switching on a heater to separate an obtained ice from the ice-maker mold, and then switching off the heater;

rotating the ejector so that an obtained ice is ejected from the ice-maker mold; and returning the ejector to an initial position.

12. The ice-making control method set forth in claim 11, wherein, when rotating an ejector such that the water supplied into the ice-maker mold is rotated to be frozen quickly, the ejector is rotated within a predetermined angular range.

13. The ice-making control method set forth in claim 12, wherein the predetermined angular range is designated such that an upper rotation limit of pins of the ejector is higher than a level of the supplied water.

14. The ice-making control method set forth in claim 12, wherein the predetermined angular range is designated such that an upper rotation limit of pins of the ejector is lower then a level of the supplied water.

15. The ice-making control method set forth in claim 11, wherein, when rotating an ejector such that the water supplied into the ice-maker mold is rotated to be frozen quickly, the ejector is rotated in one direction.

16. The ice-making control methods set forth in claim 11, wherein a rotational speed of the ejector, when rotating an ejector such that the water supplied into the ice-maker mold is rotated to be frozen quickly, is higher than that of the ejector when rotating the ejector so that an obtained ice is ejected from the ice-maker mold.

17. The ice-making control method as set forth in claim 11, wherein the heater is switched on when a temperature of the ice-maker mold is lower than a predetermined temperature, and is then switched off when a predetermined time elapses.

18. The ice-making control method as set forth in claim 11, wherein the heater is switched on when a temperature of the ice-maker mold is lower than a first predetermined temperature, and is then switched off when the temperature of the ice-maker mold reaches a second predetermined temperature higher than the first predetermined temperature.

19. The ice-making control method as set forth in claim 11, wherein the heater is switched off when the ejector reaches a predetermined position.

20. The ice-making control method as set forth in claim 11, further comprising:

sensing whether the ejected ice reaches a full ice level after rotating the ejector so that the obtained ice is ejected from the ice-maker mold, wherein subsequent to supplying water into an ice-maker mold, the method is stopped when it is determined that the ejected ice reaches a full ice level when rotating the ejector so that the obtained ice is ejected from the ice-maker mold.

* * * * *